United States Patent [19]

Hartdorn

[11] Patent Number: 4,832,013

[45] Date of Patent: May 23, 1989

[54] PORTABLE UNDERWATER BREATHING APPARATUS

[76] Inventor: Jeffrey L. Hartdorn, 48 Richmond Dr., New Smyrna Beach, Fla. 32069

[21] Appl. No.: 148,910

[22] Filed: Jan. 27, 1988

[51] Int. Cl.[4] ..... B63C 11/02; B63C 11/20

[52] U.S. Cl. ..... 128/202.14; 128/204.26; 128/201.11; 128/201.27; 417/234; 417/61; 417/363; 415/7

[58] Field of Search ..... 128/30, 28, 201.27, 128/204.26, 202.14, 201.11; 405/194, 186, 187; 441/84, 88, 89, 133, 136; 415/7; 417/61, 363, 364, 234, 331, 337

[56] References Cited

U.S. PATENT DOCUMENTS

| | | | |
|---|---|---|---|
| 3,398,878 | 8/1968 | Quiram et al. | 417/363 |
| 3,470,822 | 10/1969 | Evans et al. | 417/61 |
| 4,009,583 | 3/1977 | Buckle | 405/186 |
| 4,077,747 | 3/1978 | Burenga | 417/234 |
| 4,389,166 | 6/1983 | Harvey et al. | 417/234 |
| 4,553,902 | 11/1985 | Eberhardt | 415/7 |
| 4,674,493 | 6/1987 | Mitchell | 128/204.26 |

*Primary Examiner*—Edgar S. Burr
*Assistant Examiner*—Kimberly L. Asher
*Attorney, Agent, or Firm*—Duckworth, Allen, Dyer & Doppelt

[57] ABSTRACT

A portable floating apparatus for providing pressurized air to a submerged diver. The apparatus is comprised of the combination of a gasoline engine and an air compressor, said combination being housed in a buoyant container similar to a suitcase. The gasoline engine is preferably a two-stroke engine which drives the air compressor. The top of the container has large outlets for the intake of fresh air for compression, engine cooling and the exit of exhaust gases. These outlets have cowlings extending therefrom to reduce flooding by water from spraying or waves in rough seas. A small outlet on the side of the container with a coupling allows a flexible hose to supply air to a submerged diver. An optional fan may be inserted in the duct of one cowling to provide additional ventilation and cooling. The air supply hose, cowlings and other exterior components can be stored in the container when not in use. A handle is affixed to one side and feet on the opposite side of the container to allow the container to be carried or rested on its side in the same manner as a suitcase or briefcase. Thus, this apparatus is self-contained, compact and lightweight, unlike any such prior devices.

12 Claims, 1 Drawing Sheet

PORTABLE UNDERWATER BREATHING APPARATUS

BACKGROUND OF THE INVENTION

The present invention relates to underwater breathing apparatuses and more particularly to an above-water apparatus for pumping air to a submerged diver.

Over the centuries people have searched for new ways and new apparatuses that would enable them to stay underwater longer without returning to the surface for air. The simplest, a snorkel, consists of a tube which extends from the swimmer's mouth to the surface. Among the disadvantages of a snorkel is that a swimmer has to hold his or her breath if he or she goes any deeper below the surface than the length of the snorkel tube and, thus, the depth and time below the surface are very limited. Another apparatus is a pressurized tank which a diver wears on his or her back to supply air through a hose to a regulator in the diver's mouth. With this apparatus a diver can breath at depths below the surface with the tank air at sufficient pressure to compensate for the water pressure at the particular depth. However, such a tank is heavy and very cumbersome to carry. Furthermore, time under the water is still limited by the amount of compressed air in the tank. Moreover, such a device requires a diver to undergo an extensive training course because of the dangers involved in breathing high compressed air.

A third method which enables a diver to breath underwater is an apparatus having a pump which floats on the water's surface or is contained in a boat or otherwise and which pumps air through a pressure hose to a submerged diver. This pumped air may be fed to the diver through a regulator or may simply be fed into a pressurized suit worn by the diver, such as for deep sea diving. It is this third method for which the present invention is designed.

Some patented apparatuses do pump air from above the water's surface to a diver. The most pertinent of these includes U.S. Pat. Nos. 4,674,493 by Mitchell and 3,398,878 by Quiram, et al. The earliest of these, U.S. Pat. No. 3,398,878, uses a gasoline engine and compressor combination with a rubber inflatable innertube surrounding same for flotation. Unfortunately, this latter device is very bulky and heavy due to the design and the use of a heavy four-stroke engine. Thus, such a device is awkward to transport. Moreover, a gasoline engine presents a risk of air contamination from the exhaust fumes in the system. U.S. Pat. No. 4,674,493 seeks to remedy this problem of bulkiness and the risk of air contamination from exhaust fumes by placing a compressor and battery-powdered electric motor in a waterproof, buoyant container. But this apparatus requires a separate tank to store the air and a heavy battery, thereby once again adding to the bulkiness of the system and, thus, making it not portable. Also, the period of time over which air can be provided by this latter device is limited by the time the battery will last without recharging.

Thus, there still remains the need for a lightweight, compact and easily portable floating device which can safely pump air to a submerged swimmer, which is fulfilled by the instant invention.

SUMMARY OF THE INVENTION

The primary object of the present invention is to provide a floating apparatus for supplying pressurized air to a submerged diver.

Another object is to provide such a device which is easily portable and compact.

An even further object is to provide such a device which is lightweight so that it can be carried easily by a diver.

An even further object of the invention is to provide such an apparatus which eliminates the risk of air contamination.

And yet another object is to provide a device which provides for the elimination of excess heat generated by the engine and compressor, thereby reducing wear and tear on the apparatus.

The instant invention accomplishes the above and other objects by providing an engine and air compressor assembly housed in a semi-sealed container, similar to a suitcase, for the dual purpose of providing flotation and a portable carrying case. To the outside of the container are affixed a carrying handle and feet which allow the container to be supported on its edge, again in the manner of a briefcase.

The container itself is watertight below the waterline and water resistant above the waterline. The upper portion of the container has openings or apertures on top for the intake of fresh air for compression and engine cooling and the exit of exhaust gases. The apertures on the upper portion of the container are protected from spray and water by detachable cowlings which extend upward from the apertures. When the apparatus is not in use, the bases of the cowlings are recessed so that the top of the case is free of protrusions. Also on the upper portion above the waterline is an outlet with adapter to be coupled to a flexible hose to supply air directly to a submerged swimmer.

A lightweight, two-stroke engine is used in order to reduce weight and size. The use of a two-stroke engine also eliminates the possibility of crankcase oil spillage and allows for operation of the air compressor through a wide range of attitudes.

Both the engine and the compressor can produce a considerable amount of heat. This heat buildup problem was not addressed in the aforementioned patented devices. In the present invention the engine and compressor are cooled not only through natural air, but also positive air flow produced by an internal fan or blower. Also, water cooling is achieved by conduction of heat from the exterior of the container directly to the water.

The apparatus could even incorporate a continuously operating pump for elimination of any water which may accumulate in the bottom of the container, although such a water accumulation problem should not occur except on very rough seas.

Attachments are provided within the case for the storage of hoses, regulators, cowlings, exhaust pipe and a diver's flag which extends from one of the cowlings when the device is in use.

Other objects, advantages and features of the present invention will become readily apparent from the following detailed description of the specific embodiments thereof when read in conjunction with the accompanying drawings.

BRIEF DESCRIPTION OF THE DRAWINGS

The drawings which accompany this application are as follows.

DETAILED DESCRIPTION OF THE PREFERRED EMBODIMENT

Figure 1:
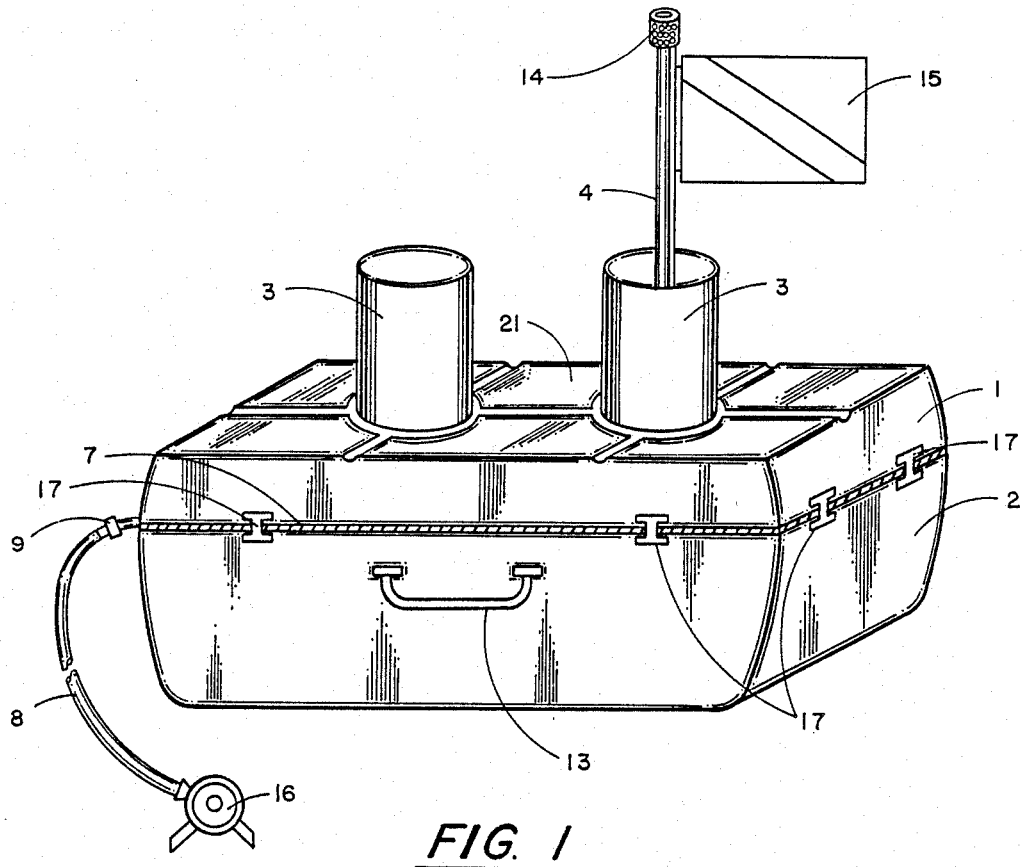
FIG. 1 is a perspective view of the exterior of the invention as assembled for use.
Figure 2:
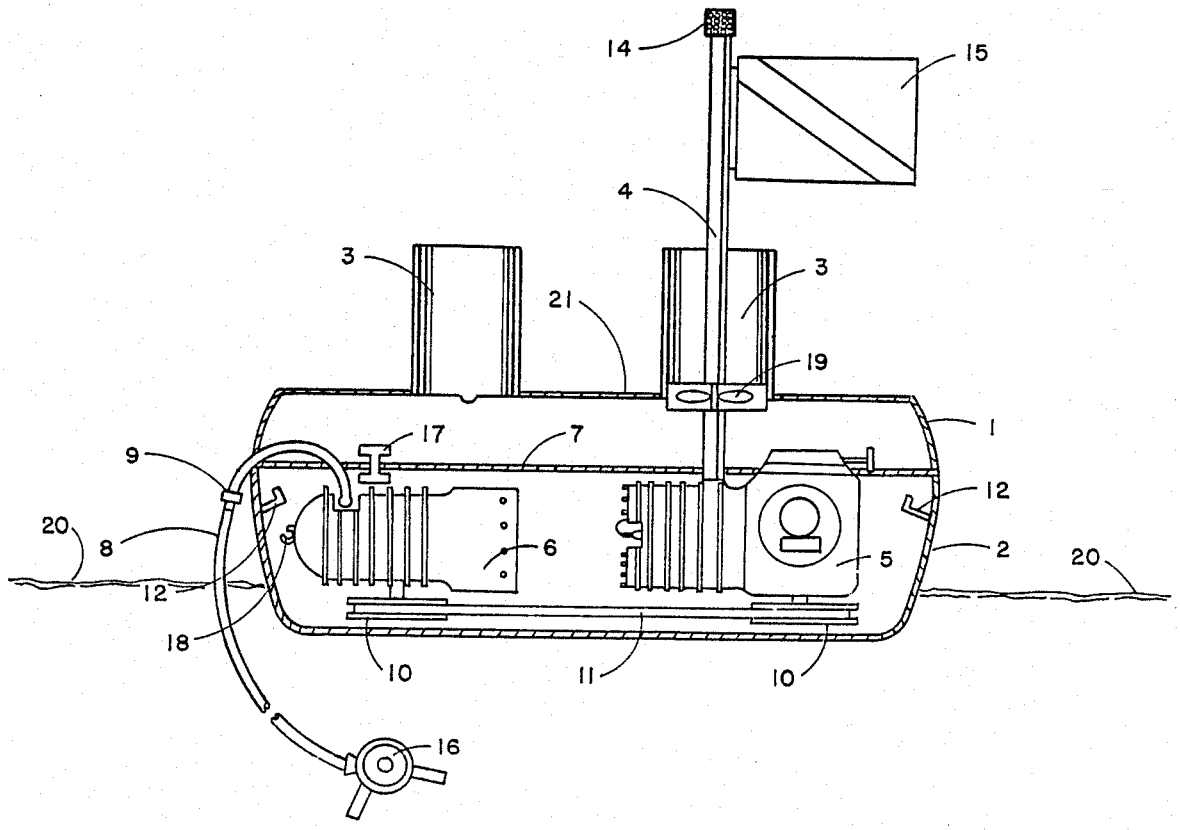
FIG. 2 is a side cross-sectional view of the invention in the water showing the various components of the invention.

Referring in detail to the drawings, FIG. 1 shows the exterior of the invention in perspective. The container of the apparatus itself consists of an upper portion 1 and lower portion 2 which are held together by buckles or clamps 17. These buckles 17 allow the upper portion 1 to be detached to provide access to the internal components and for storing other components. Between the upper portion 1 and lower portion 2 of the container is a rubber gasket or seal 7, which prevents the water from entering into the container when closed and in use. The container has a carrying handle 13 on its side so that the apparatus can be carried just like a suitcase for easy portability.

When the present invention is assembled, the cowlings 3 are screwed into the top 21 of the upper portion 1 of the container. These cowlings 3 provide an air inlet for compression and also for cooling the engine 5. One cowling 3 also has an exhaust pipe 4 passing through it for purposes of carrying exhaust gases from the gasoline engine 5 in the container. A diver's flag 15 can be attached to the exhaust pipe 4 so as to warn boaters and others there are divers beneath the water. A muffler 14 is attached at the top of the exhaust pipe 4 for quieter operation. The remaining components which can be seen in FIG. 1, consist of the air hose 8 which is connected by a coupling 9 to the hose 8 as it comes out of the apparatus. In turn, this hose 8 leads to the air regulator 16 which is inserted into the diver's mouth for breathing.

The internal components of the apparatus consist of two major items; one, a gasoline engine 5 and the other a compressor 6. The gasoline engine 5 is preferrably a two-stroke gasoline engine which is lighter in weight than the normal four-stroke engine and, yet, transmits sufficient power to the compressor 6 via the pulleys 10 connected by a fan belt 11 so as to compress sufficient air for the diver. The air pump or compressor 6 contains a pressure relief valve 18 in the event the pressure exceeds a predetermind pressure level. The compressor 6 can be controlled to provide varying degrees of pressure for the diver. An optional fan 19 can be connected by rotor to the top of the engine 5 to provide cooling of the engine 5 and more efficient exiting of heat and the exhaust gases to further decrease the possibility of air contamination.

When the apparatus is disassembled, all the exterior components fit neatly within the container for carrying. For instance, the hose 8 and regulator 16 are placed around the interior circumference of the container on attachments 12. Furthermore, the cowlings 3 unscrew as well as does the exhaust pipe 4 for storing within the container. In this manner the whole apparatus becomes compact enough to be carried by almost any diver. This advantage of being carried is in sharp contrast to prior devices which are very bulky and cumbersome due to the requirement that a rubber tube be used for flotation purposes.

The components of the apparatus can be made of standard materials. For instance, the upper and lower portions of the case could be made of lighweight, rigid plastic similar to a briefcase. The remaining components, with the exception of the gasket 7 and the hose 8, which may be made of rubber, are likely to be made of aluminum or other lightweight metal alloys.

As described in detail hereinabove, it should be apparent that there has been provided a new, useful and nonobvious apparatus to provide a nearly inexhaustable supply of compressed air to a submerged diver. Unlike the prior devices and apparatuses which have attemped to do this, the present invention is easily portable, lightweight and compact enough to be carried by a diver. This device provides means of exiting exhaust air via an exhaust pipe and muffler as well as an optional fan to eliminate the risk of air contamination to the submerged diver. Furthermore, all the components of the device can be easily stored within the container for easy portability.

While specific embodiments of the invention have been described in detail hereinabove, it is to be understood that various modifications may be made from the specific details described hereinabove without departing from the spirit and scope of the invention as set forth in the appended claims.

I claim:

1. A lightweight, easily portable floating apparatus for supplying pressurized air to a submerged diver comprising:

a rigid, buoyant container having a relatively flat top, bottom, and side walls, said container shaped and dimensioned as a suitcase with a carrying handle along a sidewall, and having a lower portion adapted to extend partially below the waterline and an upper portion above the waterline when in use, said lower portion being sealably connected to aid upper portion, the upper portion having air openings on the top thereof;

a gasoline engine attached to the inside of the lower portion of the container;

a compressor coupled to said engine, said compressor being connected to a hose passing through said buoyant container to supply air to the diver; and wherein said floating apparatus is buoyant and operable without use of any inflatable or buoyant devices exterior to said suitcase-shaped container.

2. The apparatus of claim 1 having an exhaust pipe connected to the top of the engine and extending upward through one of the air openings in the upper portion of the container.

3. The apparatus of claim 1 wherein detachable cowlings extend upward from the air openings to help prevent water from getting into the container.

4. A lightweight, easily portable floating apparatus for supplying pressurized air to a submerged diver comprising:

a rigid, buoyant container having a relatively flat top, bottom, and side walls, said container shaped and dimensioned as a suitcase with a carrying handle along a sidewall, and having a lower portion adapted to extend partially below the waterline and an upper portion above the waterline when in use, said lower portion being sealably connected to said upper portion, the upper portion having air openings on the top thereof, detachable cowlings extending upward from said openings and a carrying handle on one side and feet on the other side for carrying and resting said container;

a gasoline engine attached to the inside of the lower portion of the container having an exhaust pipe extending upward through one of the air openings in the upper portion of the container;

a compressor coupled to said engine, said compressor being connected to a hose passing through said buoyant container to supply air to the diver; and wherein said floating apparatus is buoyant and operable without use of any inflatable or buoyant devices exterior to said suitcase-shaped container.

5. The apparatus of claim 2 wherein the exhaust pipe has a muffler on the top thereof.

6. The apparatus of claim 4 wherein the buoyant container has a flag attached to the side thereto.

7. The apparatus of claim 2, 3, 4, 5 or 6 having a fan connected above the engine in one of the air openings which rotates when the engine is running to provide additional cooling and ventilation.

8. The apparatus of claim 1 or 4 wherein the compressor is coupled to said engine by means of a fan belt around pulleys on the compressor and engine.

9. A lightweight, easily portable air-supply system for underwater divers and which is easily transportable on commercial airlines, comprising:

a non-inflatable buoyant container shaped and dimensioned as a suitcase having a relatively flat top, bottom and side walls and including at least one air-intake opening and one exhaust opening extending through said top wall and having a carrying handle along a sidewall thereof;

a cowling attachable in, and extending out of said air-intake opening and movable in said openings to avoid a protrusion from said top wall during transport;

a gasoline engine fixed with said suitcase-shaped container and having an exhaust pipe extending through said exhaust opening;

a compressor fixed within said suitcase-shaped container and operatively coupled with said engine; and an air hose connected to said compressor and extending through said container for supplying air to an underwater diver.

10. The portable air-supply system recited in claim 9 wherein said exhaust pipe is detachable from said gasoline engine.

11. The portable air-supply system recited in claim 9 or 10 wherein said cowling, said exhaust pipe and said air hose are all dimensioned for storage within said suitcase-shaped container during transport.

12. The portable air-supply system recited in claim 9 wherein said air hose extends through a side wall of said buoyant container, which sidewall is opposite from said exhaust opening.

* * * * *